US011993992B2

(12) United States Patent
Al-Mousa

(10) Patent No.: US 11,993,992 B2
(45) Date of Patent: May 28, 2024

(54) MODIFIED CEMENT RETAINER WITH MILLING ASSEMBLY

(71) Applicant: Saudi Arabian Oil Company, Dhahran (SA)

(72) Inventor: Ahmed Abdulaziz Al-Mousa, Dhahran (SA)

(73) Assignee: Saudi Arabian Oil Company, Dhahran (SA)

( * ) Notice: Subject to any disclaimer, the term of this patent is extended or adjusted under 35 U.S.C. 154(b) by 89 days.

(21) Appl. No.: 17/897,987

(22) Filed: Aug. 29, 2022

(65) Prior Publication Data

US 2024/0068312 A1 Feb. 29, 2024

(51) Int. Cl.
*E21B 33/13* (2006.01)
*E21B 23/06* (2006.01)

(52) U.S. Cl.
CPC ..... *E21B 23/06* (2013.01); *E21B 33/13* (2013.01)

(58) Field of Classification Search
CPC ..... E21B 23/06; E21B 33/13
See application file for complete search history.

(56) References Cited

U.S. PATENT DOCUMENTS

| | | | |
|---|---|---|---|
| 880,404 | A | 2/1908 | Sanford |
| 1,591,264 | A | 7/1926 | Baash |
| 1,789,993 | A | 1/1931 | Switzer |
| 1,896,482 | A | 2/1933 | Crowell |
| 1,949,498 | A | 3/1934 | Frederick et al. |
| 2,121,002 | A | 6/1938 | Baker |
| 2,121,051 | A | 6/1938 | Ragan et al. |
| 2,187,487 | A | 1/1940 | Burt |
| 2,189,697 | A | 2/1940 | Baker |
| 2,222,233 | A | 11/1940 | Mize |
| 2,286,075 | A | 6/1942 | Evans |
| 2,304,793 | A | 12/1942 | Bodine |

(Continued)

FOREIGN PATENT DOCUMENTS

| | | |
|---|---|---|
| AU | 636642 | 5/1993 |
| AU | 2007249417 | 11/2007 |

(Continued)

OTHER PUBLICATIONS

Bruton et al., "Whipstock Options for Sidetracking," Oilfield Review, vol. 26, No. 1, Spring 2014, 10 pages.

(Continued)

*Primary Examiner* — Steven A MacDonald
(74) *Attorney, Agent, or Firm* — Fish & Richardson P.C.

(57) ABSTRACT

A modified cement retainer with milling assembly includes an elongate body that includes a first hollow portion near a first end of the body and a second portion near a second end of the body. A wellbore milling tool is positioned within the first hollow portion. The wellbore milling tool can perform milling operations within a wellbore. A cement flow pathway is defined within the body and the wellbore milling tool. The cement flow pathway extends end to end through the body, and passes through the wellbore milling tool. The cement flow pathway can flow cement through the well tool. A tool retainer is attached to the body. The tool retainer is can retain the wellbore milling tool within the first hollow portion of the elongate body and allow lowering the wellbore milling tool attached to the body within the wellbore.

14 Claims, 4 Drawing Sheets

(56) References Cited

U.S. PATENT DOCUMENTS 2,316,402 A 4/1943 Canon
2,327,092 A 8/1943 Botkin
2,411,260 A 11/1946 Glover et al.
2,546,978 A 4/1951 Collins et al.
2,672,199 A 3/1954 McKenna
2,707,998 A 5/1955 Baker et al.
2,728,599 A 12/1955 Moore
2,751,010 A 6/1956 Trahan
2,806,532 A 9/1957 Baker
2,881,838 A 4/1959 Morse et al.
2,912,053 A 11/1959 Bruekelman
2,912,273 A 11/1959 Chadderdon et al.
2,915,127 A 12/1959 Abendroth
2,965,175 A 12/1960 Ransom
2,965,177 A 12/1960 Le Bus et al.
3,116,799 A 1/1964 Lemons
3,147,536 A 9/1964 Lamphere
3,225,828 A 12/1965 Wisenbaker et al.
3,369,603 A 2/1968 Trantham
3,381,748 A 5/1968 Peters et al.
3,382,925 A 5/1968 Jennings
3,667,721 A 6/1972 Vujasinovic
3,897,038 A 7/1975 Le Rouax
3,915,426 A 10/1975 Le Rouax
4,030,354 A 6/1977 Scott
4,042,019 A 8/1977 Henning
4,059,155 A 11/1977 Greer
4,099,699 A 7/1978 Allen
4,190,112 A 2/1980 Davis
4,227,573 A 10/1980 Pearce et al.
4,254,983 A 3/1981 Harris
4,276,931 A 7/1981 Murray
4,285,400 A 8/1981 Mullins
4,289,200 A 9/1981 Fisher
4,296,822 A 10/1981 Ormsby
4,349,071 A 9/1982 Fish
4,391,326 A 7/1983 Greenlee
4,407,367 A 10/1983 Kydd
4,412,130 A 10/1983 Winters
4,413,642 A 11/1983 Smith et al.
4,422,948 A 12/1983 Corley et al.
4,538,684 A 9/1985 Sheffield
4,562,888 A 1/1986 Collet
4,611,658 A 9/1986 Salerni et al.
4,696,502 A 9/1987 Desai
4,735,268 A 4/1988 Harris et al.
4,791,992 A 12/1988 Greenlee et al.
4,834,184 A 5/1989 Streich et al.
4,869,321 A 9/1989 Hamilton
4,898,245 A 2/1990 Braddick
4,928,762 A 5/1990 Mamke
4,953,617 A 9/1990 Ross et al.
5,012,863 A 5/1991 Springer
5,117,909 A 6/1992 Wilton et al.
5,129,956 A 7/1992 Christopher et al.
5,176,208 A 1/1993 Lalande et al.
5,178,219 A 1/1993 Streich et al.
5,197,547 A 3/1993 Morgan
5,295,541 A 3/1994 Ng et al.
5,330,000 A 7/1994 Givens et al.
5,358,048 A 10/1994 Brooks
5,507,346 A 4/1996 Gano et al.
5,580,114 A 12/1996 Palmer
5,678,635 A 10/1997 Dunlap et al.
5,775,428 A * 7/1998 Davis ..... E21B 7/061 166/117.6
5,833,001 A 11/1998 Song et al.
5,842,518 A 12/1998 Soybel et al.
5,924,489 A 7/1999 Hatcher
5,944,101 A 8/1999 Hearn
6,138,764 A 10/2000 Scarsdale et al.
6,276,452 B1 8/2001 Davis et al.
6,371,204 B1 4/2002 Singh et al.
6,491,108 B1 12/2002 Slup et al.
6,595,289 B2 7/2003 Tumlin et al.
6,688,386 B2 2/2004 Cornelssen
6,768,106 B2 7/2004 Gzara et al.
6,808,023 B2 10/2004 Smith et al.
6,899,178 B2 5/2005 Tubel
7,049,272 B2 5/2006 Sinclair et al.
7,096,950 B2 8/2006 Howlett et al.
7,117,956 B2 10/2006 Grattan et al.
7,188,674 B2 3/2007 McGavern, III et al.
7,188,675 B2 3/2007 Reynolds
7,231,975 B2 6/2007 Lavaure et al.
7,249,633 B2 7/2007 Ravensbergen et al.
7,255,178 B2 8/2007 Slup et al.
7,284,611 B2 10/2007 Reddy et al.
7,405,182 B2 7/2008 Verrett
7,424,909 B2 9/2008 Roberts et al.
7,488,705 B2 2/2009 Reddy et al.
7,497,260 B2 3/2009 Telfer
7,591,305 B2 9/2009 Brookey et al.
7,600,572 B2 10/2009 Slup et al.
7,712,527 B2 5/2010 Roddy
7,762,323 B2 7/2010 Frazier
7,802,621 B2 9/2010 Richards et al.
7,934,552 B2 5/2011 La Rovere
7,965,175 B2 6/2011 Yamano
8,002,049 B2 8/2011 Keese et al.
8,453,724 B2 6/2013 Zhou
8,496,055 B2 7/2013 Mootoo et al.
8,579,024 B2 11/2013 Mailand et al.
8,770,276 B1 7/2014 Nish et al.
9,109,433 B2 8/2015 DiFoggio et al.
9,133,671 B2 9/2015 Kellner
9,212,532 B2 12/2015 Leuchtenberg et al.
9,359,861 B2 6/2016 Burgos
9,410,066 B2 8/2016 Ghassemzadeh
9,416,617 B2 8/2016 Wiese et al.
9,574,417 B2 2/2017 Laird et al.
9,657,213 B2 5/2017 Murphy et al.
9,695,639 B2 * 7/2017 Vincent ..... E21B 7/061
10,280,706 B1 5/2019 Sharp, III
10,837,254 B2 11/2020 Al-Mousa et al.
11,142,976 B2 10/2021 Al-Mousa et al.
11,230,904 B2 1/2022 Al-Mousa et al.
11,391,113 B2 7/2022 Al-Mousa et al.
2002/0053428 A1 5/2002 Maples
2003/0047312 A1 3/2003 Bell
2003/0132224 A1 7/2003 Spencer
2004/0040707 A1 3/2004 Dusterhoft et al.
2005/0167097 A1 8/2005 Sommers et al.
2005/0263282 A1 12/2005 Jeffrey et al.
2006/0213656 A1 9/2006 Clifton
2007/0137528 A1 6/2007 Le Roy-Delage et al.
2007/0181304 A1 8/2007 Rankin et al.
2008/0236841 A1 10/2008 Howlett et al.
2008/0251253 A1 10/2008 Lumbye
2008/0314591 A1 12/2008 Hales et al.
2009/0194290 A1 8/2009 Parks et al.
2009/0250220 A1 10/2009 Stamoulis
2010/0263856 A1 10/2010 Lynde et al.
2010/0270018 A1 10/2010 Howlett
2011/0036570 A1 2/2011 La Rovere et al.
2011/0067869 A1 3/2011 Bour et al.
2011/0203794 A1 8/2011 Moffitt et al.
2011/0278021 A1 11/2011 Travis et al.
2012/0012335 A1 1/2012 White et al.
2012/0118571 A1 5/2012 Zhou
2012/0170406 A1 7/2012 DiFoggio et al.
2013/0240207 A1 9/2013 Frazier
2013/0296199 A1 11/2013 Ghassemzadeh
2014/0158350 A1 6/2014 Castillo et al.
2015/0122495 A1 * 5/2015 Vincent ..... E21B 7/061 166/117.5
2015/0226017 A1 * 8/2015 Telfer ..... E21B 17/046 175/320
2016/0084034 A1 3/2016 Roane et al.
2016/0237810 A1 8/2016 Beaman et al.
2016/0281458 A1 9/2016 Greenlee
2016/0305215 A1 10/2016 Harris et al.
2016/0340994 A1 11/2016 Ferguson et al.
2017/0044864 A1 2/2017 Sabins et al.

(56) References Cited

U.S. PATENT DOCUMENTS

| | | | | |
|---|---|---|---|---|
| 2017/0058628 | A1 | 3/2017 | Van Wijk et al. | |
| 2017/0067313 | A1 | 3/2017 | Connell et al. | |
| 2017/0089166 | A1 | 3/2017 | Sullivan | |
| 2018/0010418 | A1 | 1/2018 | VanLue | |
| 2018/0119507 | A1* | 5/2018 | Nordenstam | E21B 47/12 |
| 2018/0128071 | A1* | 5/2018 | Clem | E21B 29/005 |
| 2018/0187498 | A1 | 7/2018 | Soto et al. | |
| 2018/0245427 | A1 | 8/2018 | Jimenez et al. | |
| 2018/0252069 | A1 | 9/2018 | Abdollah et al. | |
| 2019/0024473 | A1 | 1/2019 | Arefi | |
| 2019/0186232 | A1 | 6/2019 | Ingram | |
| 2019/0203551 | A1 | 7/2019 | Davis et al. | |
| 2019/0284893 | A1* | 9/2019 | Rossing | E21B 33/13 |
| 2019/0284898 | A1 | 9/2019 | Fagna et al. | |
| 2020/0040683 | A1* | 2/2020 | Taylor, Jr. | E21B 7/061 |
| 2020/0056446 | A1 | 2/2020 | Al-Mousa et al. | |
| 2020/0157903 | A1* | 5/2020 | Al-Mousa | E21B 29/002 |
| 2020/0325746 | A1* | 10/2020 | Lerbrekk | E21B 33/13 |
| 2021/0025259 | A1 | 1/2021 | Al-Mousa et al. | |
| 2021/0140267 | A1 | 5/2021 | Al-Mousa et al. | |
| 2023/0091920 | A1* | 3/2023 | Al-Mousa | E21B 31/06 166/55.6 |
| 2023/0272672 | A1* | 8/2023 | Al-Mousa | E21B 17/14 166/117.6 |

FOREIGN PATENT DOCUMENTS

| | | |
|---|---|---|
| AU | 2017225085 | 8/2018 |
| CA | 2734032 | 6/2016 |
| CN | 107387018 | 11/2017 |
| DK | 2236742 | 8/2017 |
| GB | 958734 | 5/1964 |
| GB | 2021178 | 11/1979 |
| GB | 2392183 | 2/2004 |
| GB | 2492663 | 1/2013 |
| WO | WO 1989012728 | 12/1989 |
| WO | WO 2002090711 | 11/2002 |
| WO | WO 2010132807 | 11/2010 |
| WO | WO 2012164023 | 12/2012 |
| WO | WO 2017043977 | 3/2017 |
| WO | WO 2018017104 | 1/2018 |
| WO | WO 2019132877 | 7/2019 |

OTHER PUBLICATIONS

Scribd [online], "Milling Practices and Procedures," retrieved from URL <https://www.scribd.com/document/358420338/Milling-Rev-2-Secured>, 80 pages.

Tam International Inflatable and Swellable Packers, "TAM Scab Liner brochure," Tam International, available on or before Nov. 15, 2016, 4 pages.

* cited by examiner

MODIFIED CEMENT RETAINER WITH MILLING ASSEMBLY

TECHNICAL FIELD

This disclosure relates to wellbore operations, for example, wellbore drilling and makeover operations.

BACKGROUND

Hydrocarbons trapped in subsurface reservoirs can be raised to the surface of the Earth (that is, produced) through wellbores formed from the surface to the subsurface reservoirs. Wellbore drilling systems are used to drill wellbores through a subterranean zone (for example, a formation, a portion of a formation or multiple formations) to the subsurface reservoir. Wellbore drilling operations involve lowering well tools into the wellbore and perform operations inside the wellbore using the lowered tools. Cementing is one such operation in which cement is flowed from the surface to a downhole location and allowed to harden. The cement is flowed through a cement retainer. In some instances, removing the cement retainer or other cement-flowing tool from the wellbore can be more expensive than simply milling through the tool and flowing the resulting debris from within the wellbore.

SUMMARY

This disclosure relates to a modified cement retainer with milling assembly.

Certain aspects of the subject matter described here can be implemented as a method. A wellbore milling tool is positioned in a hollow portion of an elongate well tool body. The wellbore milling tool and the well tool body define a cement flow pathway from end to end. The wellbore milling tool is connected to the well tool body by a tool retainer. The well tool body with the connected wellbore milling tool is lowered into a wellbore formed from a surface through a subterranean zone. The well tool body is installed within the wellbore at a downhole location. After the installing, the well tool body is sealingly attached to an inner wall of the wellbore at the downhole location. After installing the well tool body, cement is flowed through the cement flow pathway to a wellbore location that is downhole of the downhole location. After flowing the cement, the tool retainer is activated to separate the wellbore milling tool from the well tool body. After separating the wellbore milling tool from the well tool body, the well tool body is milled with the wellbore milling tool.

An aspect combinable with any other aspect includes the following features. Flowing the cement and milling the well tool body are implemented in a single trip into the wellbore.

An aspect combinable with any other aspect includes the following features. A packer is attached to the well tool body. To install the well tool body within the wellbore at the downhole location, the packer is deployed at the downhole location to seal against the inner wall of the wellbore.

An aspect combinable with any other aspect includes the following features. An inner diameter of the hollow portion in which the wellbore milling tool is positioned is greater than or equal to an outer diameter of a remainder of the body.

An aspect combinable with any other aspect includes the following features. An outer diameter of the wellbore milling tool is greater than or equal to the outer diameter of the remainder of the body.

An aspect combinable with any other aspect includes the following features. The tool retainer includes a shear pin. To connect the wellbore milling tool to the well tool body by the tool retainer, the shear pin is passed through a circumferential surface of the body and a notch formed on a side of the wellbore milling tool.

An aspect combinable with any other aspect includes the following features. To activate the tool retainer to separate the wellbore milling tool from the well tool body, the wellbore milling tool and the well tool body are moved axially relative to each other causing the shear pin to be sheared.

Certain aspects of the subject matter described here can be implemented as a well tool. The tool includes an elongate body that includes a first hollow portion near a first end of the body and a second portion near a second end of the body. A wellbore milling tool is positioned within the first hollow portion. The wellbore milling tool is configured to perform milling operations within a wellbore. A cement flow pathway is defined within the body and the wellbore milling tool. The cement flow pathway extends from the first end of the body to the second end of the body, and passes through the wellbore milling tool. The cement flow pathway is configured to allow flow of cement through the well tool. A tool retainer is attached to the body. The tool retainer is configured to retain the wellbore milling tool within the first hollow portion of the elongate body and to allow lowering the wellbore milling tool attached to the body within the wellbore.

An aspect combinable with any other aspect includes the following features. A packer is attached to the second portion. The packer is configured to seal against an inner wall of the wellbore.

An aspect combinable with any other aspect includes the following features. An inner diameter of the first hollow portion is greater than or equal to an outer diameter of a remainder of the body.

An aspect combinable with any other aspect includes the following features. An outer diameter of the wellbore milling tool is greater than or equal to the outer diameter of the remainder of the body.

An aspect combinable with any other aspect includes the following features. The tool retainer includes a shear pin passing through a circumferential surface of the body and a notch formed on a side of the wellbore milling tool. The shear pin is made of a material that is configured to be sheared in response to an axial movement of the wellbore milling tool and the body relative to each other.

An aspect combinable with any other aspect includes the following features. The material with which the shear pin is made is millable by the wellbore milling tool.

An aspect combinable with any other aspect includes the following features. A string is connected to the wellbore milling tool. The string is configured to lower the well tool inside the wellbore. A string mill is attached to the string axially uphole of the wellbore milling tool.

The details of one or more implementations of the subject matter described in this specification are set forth in the accompanying drawings and the description below. Other features, aspects, and advantages of the subject matter will become apparent from the description, the drawings, and the claims.

BRIEF DESCRIPTION OF THE DRAWINGS

Like reference numbers and designations in the various drawings indicate like elements.

DETAILED DESCRIPTION

Wellbore operations including cementing operations performed during drilling and workover. In one run (or trip) a cement retainer is lowered into a wellbore and is installed (or set) at a desired downhole location. Cementing operations are then performed by flowing cement through the cement retainer. In another, separate run (or separate trip), a wellbore milling tool is lowered into the wellbore to mill the cement retainer and the top of the cement to a desired depth. This disclosure describes a well tool and a method associated with the well tool that will enable a one-trip system to set the cement retainer, perform the cementing operation and mill through the cement retainer. By "one-trip," it is meant that the well tool that can perform the cementing operation and the milling operation is lowered into the wellbore in a single trip. Further, without needing another trip and using components of the well tool already lowered into the wellbore during the single trip, the cementing operation and then the milling operation are performed at the downhole location within the wellbore. By reducing multiple trips to a single trip, time to implement the excess, time to set up a rig to implement the excess trip and costs and equipment associated with excess trips can be reduced. Human error that results in choosing a milling tool of incorrect size or type can be reduced or eliminated by implementing the operations described in this disclosure.

Figure 1:
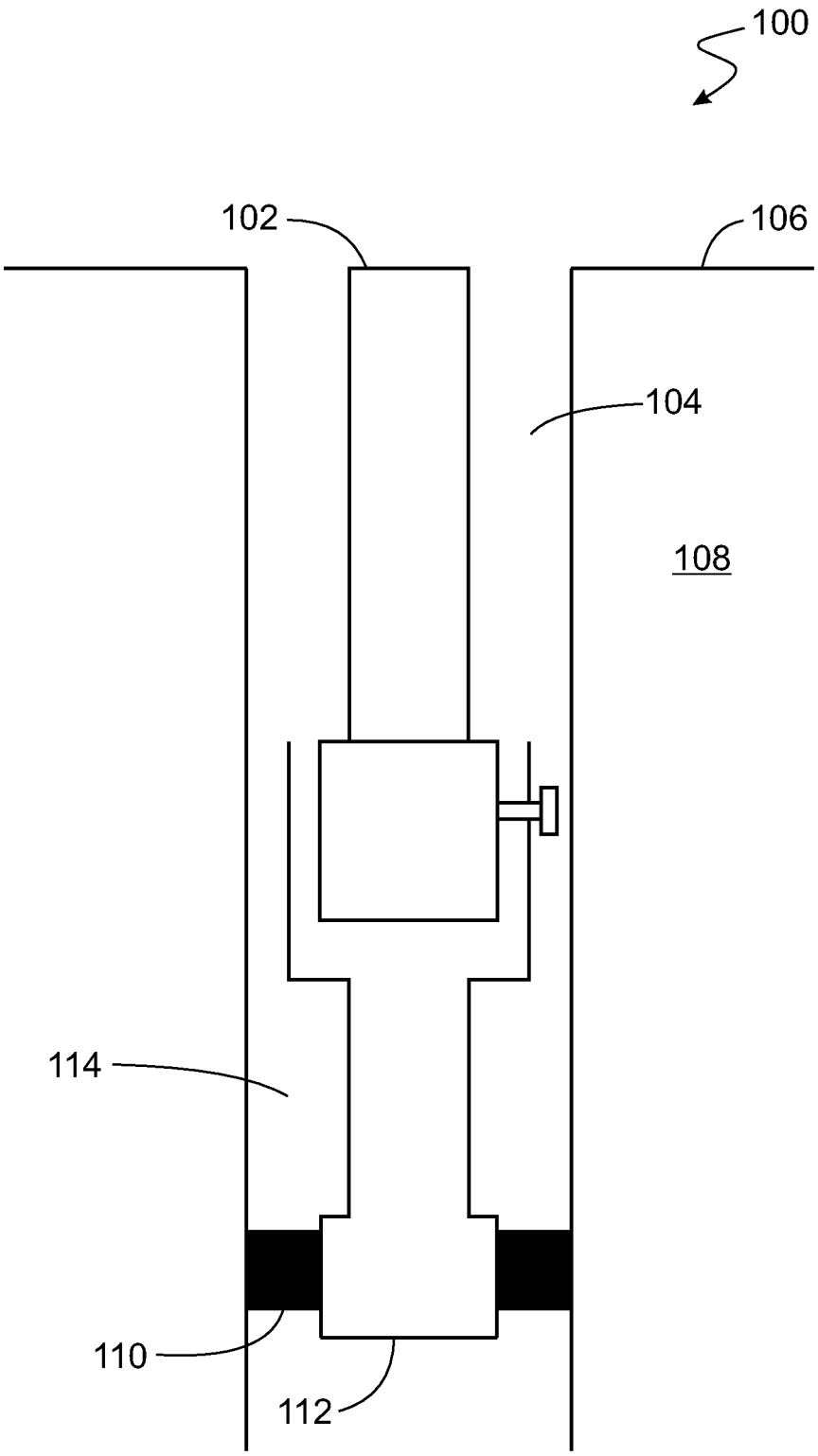
FIG. 1 is a schematic diagram of an example of a well with the well tool described in this disclosure.

FIG. 1 is a schematic diagram of an example of a well 100 with the well tool 102 described in this disclosure. The well 100 includes a wellbore 104 formed from a surface 106 through a subterranean zone 108 towards a subsurface reservoir (not shown). The well tool 102 is lowered into the wellbore 104 to a desired downhole location 110. At the downhole location 110, the well tool 102 is installed or set. Setting the well tool 102 at the downhole location 110 isolates a well region 112 downhole of the downhole location 110 from a well region 114 uphole of the downhole location 110. As described below and with references to the following figures, the well tool 102 can be used to perform cementing operations in which cement is flowed from the surface 106, through the well tool 102 and to the well region 112 downhole of the downhole location 110. Then, without raising the well tool 102 out of the wellbore 104 and without lowering another well tool into the wellbore 104 (i.e., in a single trip), portions of the well tool 102 are milled. The resulting debris can be flowed out of the wellbore 104 during a subsequent well operation.

Figure 2A:
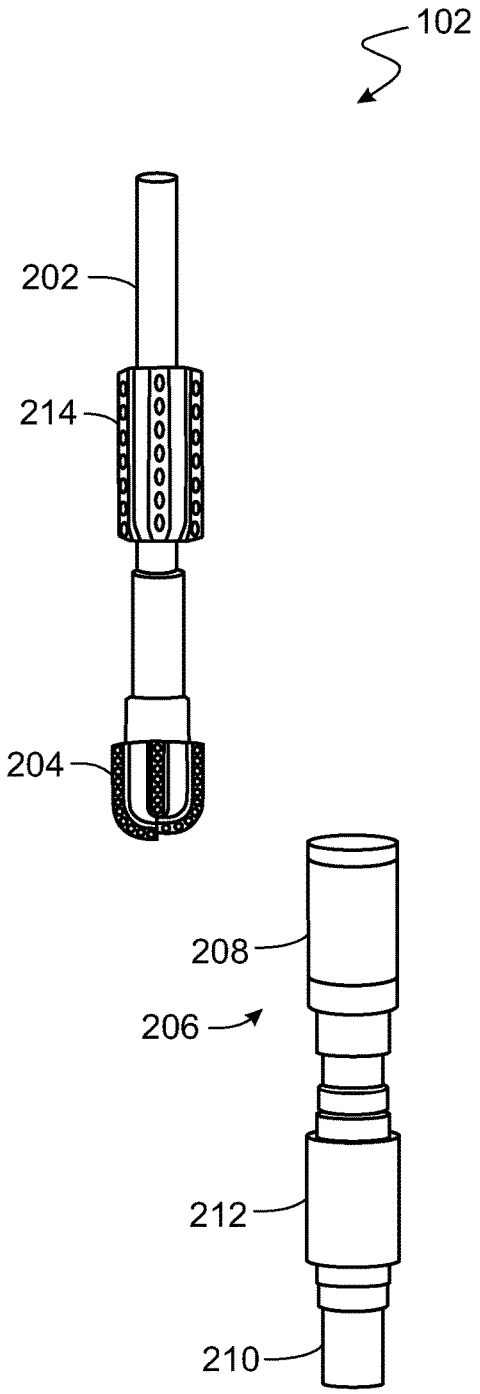
FIGS. 2A and 2B are schematic diagrams of a tool layout of the well tool of FIG. 1.
Figure 2B:
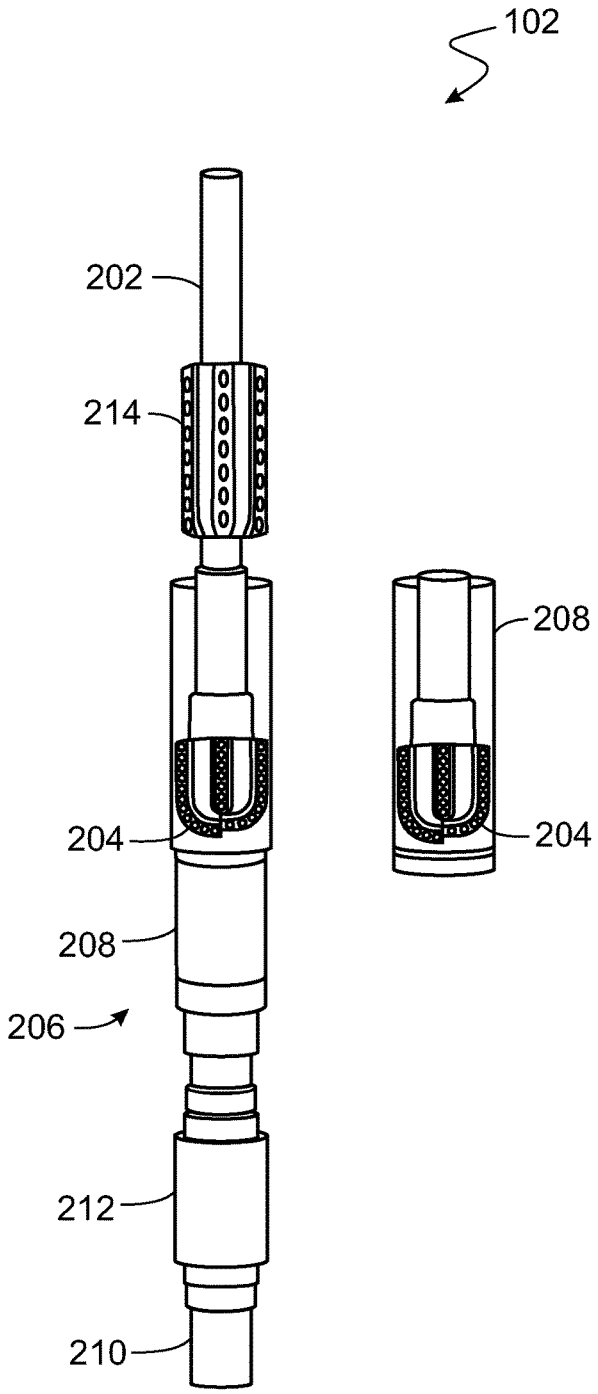

FIGS. 2A and 2B are schematic diagrams of a tool layout of the well tool 102 of FIG. 1. FIGS. 2A and 2B show the well tool 102 disassembled and assembled, respectively. The well tool 102 includes a string 202 that can be lowered into the wellbore 104 from a rig or equipment disposed at the surface 106 of the wellbore 104. For example, the string 202 can include coiled tubing, wireline, slickline or similar wellbore tubulars. A wellbore milling tool 204 is attached to an end of the string 202 that is lowered into the wellbore 104. The wellbore milling tool 204 can perform wellbore milling operations. That is, the tool 204 can mill through components installed in the well. To do so, the string 202 can be rotated to cause the wellbore milling tool 204 to rotate. Or, the string 202 can be periodically raised and lowered to cause the wellbore milling tool 204 to also be raised and lowered. During such rotational or axial motion, the wellbore milling tool 204 mills through any component that contacts the tool 204.

In some implementations, a fluid flow pathway (FIGS. 3A-3D) is formed through the wellbore milling tool 204. For example, the fluid flow pathway is formed as a hollow portion extending from one end of the tool 204 to the other end of the tool 204. The string 202 is also hollow and axially coupled to the fluid flow pathway formed in the tool 204. Fluids, e.g., cement, can be flowed through the fluid flow pathway from the surface 106, through the string 202 and through the fluid flow pathway formed in the tool 204.

The well tool 102 includes an elongate body 206 that is hollow and defines different portions (i.e., axial length segments) of different sizes. That is, while all the axial length segments are hollow, an inner diameter and an outer diameter of one axial length segment is different from an inner diameter and an outer diameter, respectively, of another axial length segment. The body 206 includes a first portion 208 near a first end of the body 206 and a second portion 210 near a second end of the body 206. The first portion 208 has an inner diameter that is greater than an outer diameter of the milling tool 204. The first portion 208 has an axial length equal to or greater than an axial length of the milling tool 204. In this arrangement, the milling tool 204 can be positioned and completely contained within the first portion 208, as shown in FIG. 2B. The remainder of the body 206 forms a second portion 210 that can have the same or different outer diameters. But, the outer diameter of the milling tool 204 is greater than the largest outer diameter of the second portion 210. In this arrangement, the milling tool 204 can mill through an entirety of the second portion 210.

A packer 212 (or similar sealing assembly) is attached to the second portion 210, e.g., nearer to an end of the second portion 210. The packer 210 allows the well tool 102 to be installed or set within the wellbore 104 at the desired downhole location 110 as described with reference to FIG. 1. In some implementations, an outer diameter of the axial length of the second portion 210 to which packer 212 is attached is equal to an outer diameter of the milling tool 204 so that the milling tool 204 can mill through the packer 212 without damaging the packer 212.

The hollow portions that extend from end to end within the body 206 extend the fluid flow pathway defined by the milling tool 204. Fluids, e.g., cement, can be flowed through the fluid flow pathway from the surface 106, through the string 202, through the fluid flow pathway formed in the tool 204, through the hollow portions within the body 206 and to locations downhole of the tool 102. In particular, the cement can be flowed through the well tool 102 to the well region 112 (FIG. 1) downhole of the downhole location 110 (FIG. 1).

A tool retainer (FIGS. 3A-3D) is attached to the body 206. The tool retainer is configured to retain the milling tool 204 within the first portion 208 and to allow lowering the milling tool 204 attached to the body 206 within the wellbore 104. As described below with reference to FIGS. 3A-3D, once the well tool 102 has been installed or set within the wellbore 104 at the desired downhole location 110, the tool retainer can be activated to allow the milling tool 204 to separate from the body 206. In operation, the tool retainer is activated after the cementing operations have been performed by flowing cement through the fluid flow pathway.

FIGS. 3A-3D are schematic diagrams of an example of an operation of the well tool 102. FIGS. 3A-3D show the milling tool 204 (FIG. 2), attached to the string 202 (FIG. 2), wholly contained within the first portion 208 and lowered into the wellbore (not shown in FIGS. 3A-3D). As described above, the tool 102 defines a fluid flow pathway 302. Also, as described above, the tool retainer retains the milling tool 204 within the first portion 208 such that the milling tool 204 and the body 206 (FIG. 2) can be lowered into the wellbore 104 (FIG. 1) together in a single trip. In some implementations, the tool retainer includes a shear pin 304 that passes through a circumferential surface 306 of the body 206 (specifically, the first portion 208). The tool retainer also includes a notch 308 formed on a side of the milling tool 204. When the shear pin 304 is radially inserted through the circumferential surface 306 into the notch 308, the shear pin 304 locks the milling tool 204 and the first portion 208 such that the two components move together axially within the wellbore 104 (FIG. 1). After the well tool 102 is set at the desired downhole location 110 (FIG. 1) by deploying the packer 212 (FIG. 2), a relative axial movement between the milling tool 204 and the body 206 causes the shearing pin 304 to be sheared. For example, the shearing pin 304 can be made of a material that can be sheared when the string 202, to which the milling tool 204 is attached, is pulled in an uphole direction after the packer 212 (FIG. 2) has been deployed.

Figures 3A, 3B, 3C, 3D:
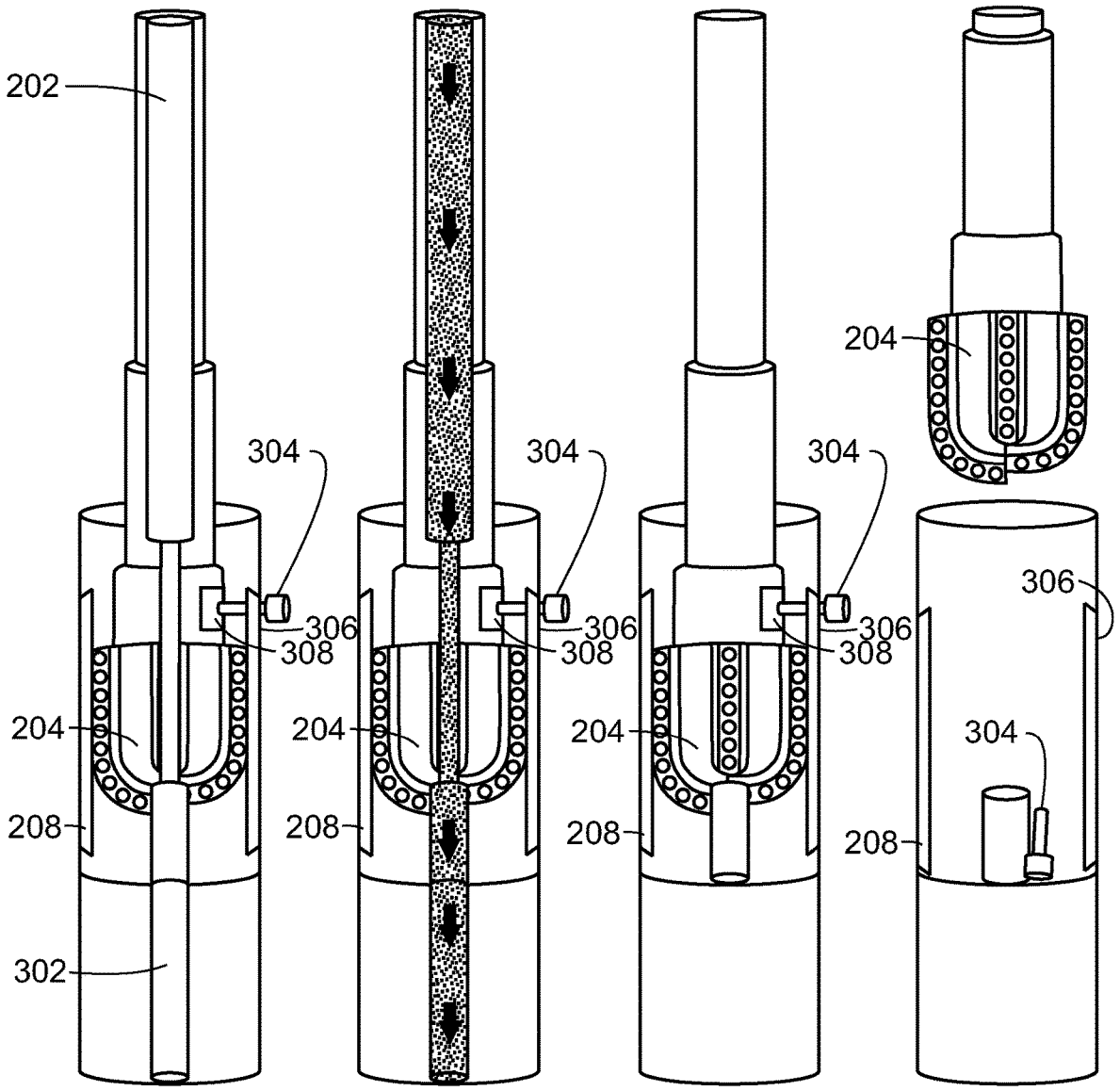
FIGS. 3A-3D are schematic diagrams of an example of an operation of the well tool of FIG. 1.

FIG. 3A shows that the first portion 208 with the milling tool 204 retained by the tool retainer is lowered into the wellbore 104 (not shown in FIG. 3A). The packer 212 (not shown in FIG. 3A) is deployed once the body 206 reaches the desired downhole location 110 (not shown in FIG. 3A). The fluid flow pathway 302 extends from the surface 106 of the wellbore 104 through the string 202 and the milling tool 204, through the hollow portion defined by the body 206 to the downhole end of the body 206. In some implementations, a separate elongate hollow tubular 302 can be disposed within the body 206 and connected (e.g., axially, end-to-end) to the milling tool 204. The tubular 302 can extend from the downhole end of the milling tool 204 to the downhole end of the body 206. FIG. 3B shows fluids, e.g., cement, being flowed through the fluid flow pathway 302. The cement is flowed from the surface 106 of the wellbore 104 to the wellbore region 112 (FIG. 1) that is downhole of the desired downhole location 110 (FIG. 1) where the packer 212 is deployed. FIG. 3C shows that the cement flow through the fluid flow pathway 302 has been stopped. The string 202 is pulled axially in an uphole direction causing the shearing pin 304 to be sheared. Consequently, the milling tool 204 is no longer connected to the first portion 208 of the body 206.

FIG. 3D shows the milling tool 204 being raised uphole of the body 206 (specifically, uphole of the first portion 208). The string 202 can then be rotated or moved axially in an uphole-downhole direction (or both), and the milling tool 204 can be brought into contact with the body 206 to mill the body 206. Because the inner diameter of the first portion 208 is greater than the outer diameter of the milling tool 204, the axial uphole-downhole motion can be implemented to contact the milling tool 204 against the first portion 208 to mill the first portion 208. Because the outer diameter of the milling tool 204 is greater than an outer diameter of the remainder of the body 206, the rotational motion of the milling tool 204 can mill the remainder of the body 206. The shearing pin 306 and any other component of the tool retainer are made of millable materials that can also be milled by the milling tool 204. In this manner, the cementing and milling operations are implemented in one-trip. That is, a separate trip to lower a milling tool to remove the body is unnecessary. In addition, the milling tool 204 need not be removed from within the wellbore 104 to mill the body.

Figure 4:
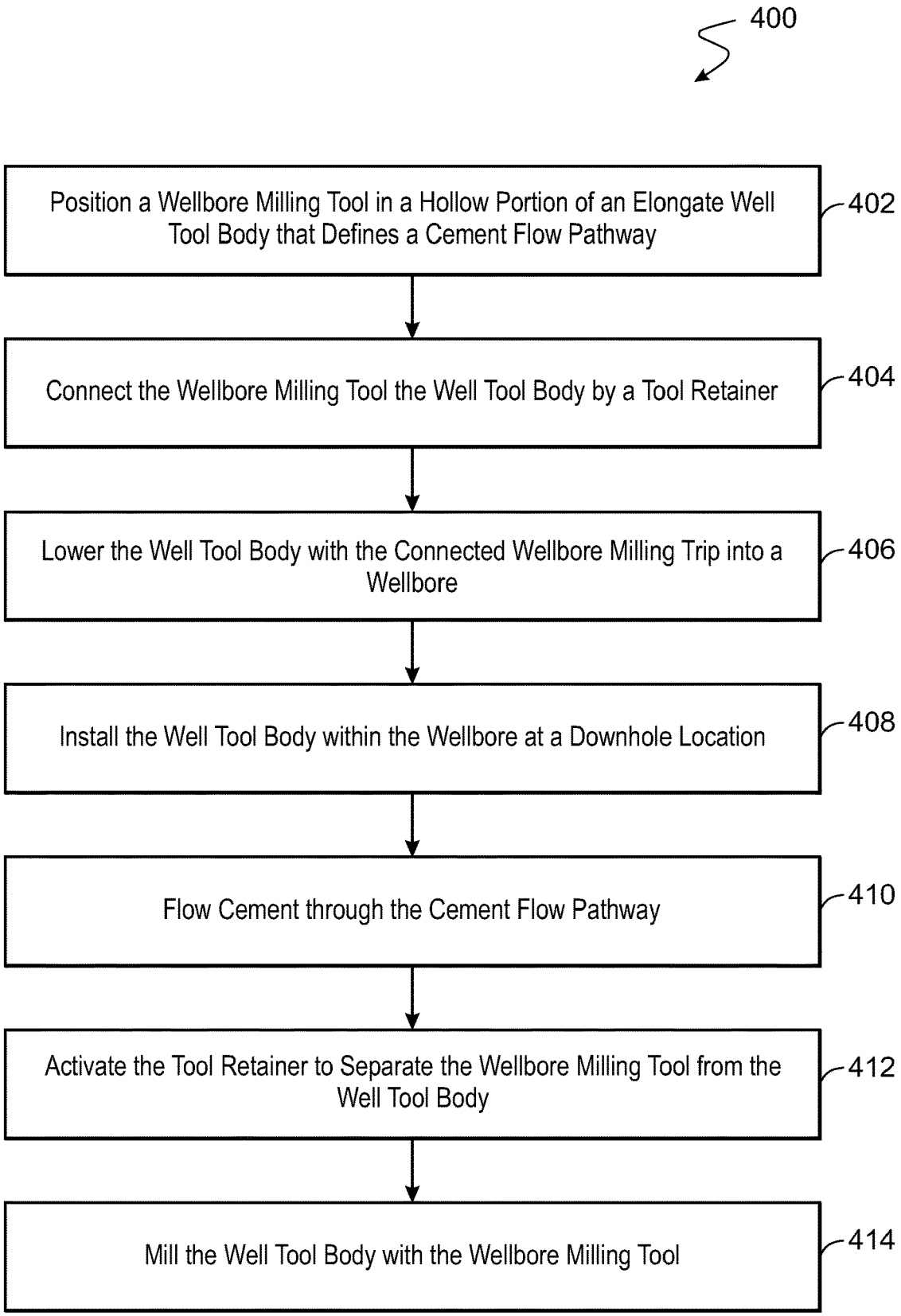
FIG. 4 is a flowchart of an example of a process of using the well tool of FIG. 1.

FIG. 4 is a flowchart of an example of a process 400 of using the well tool of FIG. 1. At 402, the well tool 102 is formed by positioning the milling tool 204 within the first portion 208 of the body 206. At 404, the milling tool 204 is connected to the body 206, specifically the first portion 208, by the tool retainer. At 406, the well tool body 206 with the connected wellbore milling tool 204 is lowered into the wellbore 104. At 408, the body 206 is installed within the wellbore 104 at the desired downhole location 110, for example, by deploying the packer 212. After the installing, the body 206 is sealingly attached to an inner wall of the wellbore 104 at the downhole location 110. At 410, after installing the body 206, cement is flowed through the fluid flow pathway (the cement flow pathway) to the wellbore location 112 that is downhole of the downhole location 110. At 412, after flowing the cement (specifically, after ceasing the flow of cement), the tool retainer is activated to separate the milling tool 204 from the body 206. At 414, after separating the milling tool 204 from the body 206, the body 206 is milled with the milling tool 204. In this manner, flowing of the cement and milling of the body 206 are implemented in a single trip into the wellbore 104.

Thus, particular implementations of the subject matter have been described. Other implementations are within the scope of the following claims. In some cases, the actions recited in the claims can be performed in a different order and still achieve desirable results. In addition, the processes depicted in the accompanying figures do not necessarily require the particular order shown, or sequential order, to achieve desirable results. In certain implementations, multitasking and parallel processing may be advantageous.

The invention claimed is:

1. A method comprising:

positioning a wellbore milling tool in a hollow portion of an elongate well tool body, wherein the wellbore milling tool and the well tool body define a cement flow pathway from end to end;

connecting the wellbore milling tool to the well tool body by a tool retainer;

lowering the well tool body with the connected wellbore milling tool into a wellbore formed from a surface through a subterranean zone;

installing the well tool body within the wellbore at a downhole location, wherein, after the installing, the well tool body is sealingly attached to an inner wall of the wellbore at the downhole location;

after installing the well tool body, flowing cement through the cement flow pathway to a wellbore location that is downhole of the downhole location;

after flowing the cement, activating the tool retainer to separate the wellbore milling tool from the well tool body; and after separating the wellbore milling tool from the well tool body, milling the well tool body with the wellbore milling tool.

2. The method of claim 1, wherein flowing the cement and milling the well tool body are implemented in a single trip into the wellbore.

3. The method of claim 1, wherein a packer is attached to the well tool body, wherein installing the well tool body within the wellbore at the downhole location comprises deploying the packer at the downhole location to seal against the inner wall of the wellbore.

4. The method of claim 3, wherein an outer diameter of the wellbore milling tool is greater than or equal to the outer diameter of the remainder of the body.

5. The method of claim 1, wherein an inner diameter of the hollow portion in which the wellbore milling tool is positioned is greater than or equal to an outer diameter of a remainder of the body.

6. The method of claim 1, wherein the tool retainer comprises a shear pin, wherein connecting the wellbore milling tool to the well tool body by the tool retainer comprises passing the shear pin through a circumferential surface of the body and a notch formed on a side of the wellbore milling tool.

7. The method of claim 6, wherein activating the tool retainer to separate the wellbore milling tool from the well tool body comprises axially moving the wellbore milling tool and the well tool body relative to each other causing the shear pin to be sheared.

8. A well tool comprising:

an elongate body comprising a first hollow portion near a first end of the body and a second portion near a second end of the body;

a wellbore milling tool positioned within the first hollow portion, the wellbore milling tool configured to perform milling operations within a wellbore;

a cement flow pathway defined within the body and the wellbore milling tool, the cement flow pathway extending from the first end of the body to the second end of the body and passing through the wellbore milling tool, the cement flow pathway configured to allow flow of cement through the well tool; and a tool retainer attached to the body, the tool retainer configured to retain the wellbore milling tool within the first hollow portion of the elongate body and to allow lowering the wellbore milling tool attached to the body within the wellbore.

9. The well tool of claim 8, further comprising a packer attached to the second portion, the packer configured to seal against an inner wall of the wellbore.

10. The well tool of claim 8, wherein an inner diameter of the first hollow portion is greater than or equal to an outer diameter of a remainder of the body.

11. The well tool of claim 10, wherein an outer diameter of the wellbore milling tool is greater than or equal to the outer diameter of the remainder of the body.

12. The well tool of claim 8, wherein the tool retainer comprises a shear pin passing through a circumferential surface of the body and a notch formed on a side of the wellbore milling tool, wherein the shear pin is made of a material that is configured to be sheared in response to an axial movement of the wellbore milling tool and the body relative to each other.

13. The well tool of claim 12, wherein the material with which the shear pin is made is millable by the wellbore milling tool.

14. The well tool of claim 8, further comprising:

a string connected to the wellbore milling tool, the string configured to lower the well tool inside the wellbore; and a string mill attached to the string axially uphole of the wellbore milling tool.

* * * * *